United States Patent [19]

Saito et al.

[11] Patent Number: 4,994,825

[45] Date of Patent: Feb. 19, 1991

[54] INK JET RECORDING HEAD EQUIPPED WITH A DISCHARGING OPENING FORMING MEMBER INCLUDING A PROTRUDING PORTION AND A RECESSED PORTION

[75] Inventors: Akio Saito, Yamato; Kazuaki Masuda, Sagamihara; Toshio Kashino, Chigasaki; Takashi Watanabe, Hiratsuka, all of Japan

[73] Assignee: Canon Kabushiki Kaisha, Tokyo, Japan

[21] Appl. No.: 373,502

[22] Filed: Jun. 30, 1989

[30] Foreign Application Priority Data

Jun. 30, 1988 [JP] Japan ..... 63-160712
Jun. 23, 1989 [JP] Japan ..... 1-159720

[51] Int. Cl.[5] ..... B41J 2/05
[52] U.S. Cl. ..... 346/140 R
[58] Field of Search ..... 346/140

[56] References Cited

U.S. PATENT DOCUMENTS 4,450,455 5/1984 Sugitani ..... 346/140
4,459,543 12/1985 Toganoh ..... 346/140
4,611,219 9/1986 Sugitani et al. .
4,723,129 2/1988 Endo et al. .
4,740,796 4/1988 Endo et al. .

FOREIGN PATENT DOCUMENTS 118873 12/1980 Japan .
58-63473 4/1983 Japan .
230949 10/1986 Japan .

*Primary Examiner*—Joseph W. Hartary
*Attorney, Agent, or Firm*—Fitzpatrick, Cella, Harper & Scinto

[57] ABSTRACT

An ink jet recording head is disclosed. The recording head includes a plate member provided with discharge openings for discharging ink and a head main body having an ink channel communicating with the discharging openings. The head main body is bonded to the plate member at a bonding surface and an uneven portion including a protruding portion and a recessed portion is formed at the bonding surface between the plate member and the head main body.

25 Claims, 7 Drawing Sheets

INK JET RECORDING HEAD EQUIPPED WITH A DISCHARGING OPENING FORMING MEMBER INCLUDING A PROTRUDING PORTION AND A RECESSED PORTION

BACKGROUND OF THE INVENTION

1. Field of the Invention

The present invention relates to an ink jet recording head which performs recording of an image onto a recording medium by discharging ink through a discharging opening, particularly to an ink jet recording head equipped with a discharging opening forming member having said discharging opening formed thereon.

Also, the present invention relates to an ink jet recording device provided with the ink jet recording head equipped with said discharging opening forming member.

2. Related Background Art

FIG. 1 is a perspective view schematically showing the external constitution of an ink jet recording device. In FIG. 1, 1 is an ink jet recording head which records a desired image by discharging ink based on a given recording signal (hereinafter called a recording head), 2 is a carriage which scans and moves in the recording line direction indicated by double-headed arrow B (main scanning direction) with the above head 1 carried thereon. The above carriage 2 is slidably supported by the guide shafts 3. 4 and moves in a reciprocal fashion in the main scanning direction as associated with the timing belt 8. The above timing belt 8 engaged with pulleys 6, 7 is driven by the carriage motor 5 through the pulley 7.

The recording paper 9 is guided by the paper pan 10 and conveyed with a paper delivering roller (not shown) pressure contacted with the pinch roller. This conveying is done by the paper delivering motor 16 as the driving source. The recording paper 9 being conveyed has tension applied thereto by the discharging paper roller 13 and the spur 14 to be pressure contacted against the heater 11 by the paper pressing plate 12 formed of an elastic member, and hence conveyed while being closely contacted with the heater 11. The recording paper 9, having ink jetted from the head 1 attached thereto is warmed by the heater 11, and &he attached ink is fixed onto the recording paper 9 through evaporation of water.

Reference numeral 15 represents a unit called a restoration system, which maintains the discharging characteristic of the ink under normal conditions by removing any foreign matter or ink increased in viscosity attached on the discharging opening (not shown) of the recording head 1.

On the recording region side of the restoration system unit 15, there is provided a cleaning blade 17 for cleaning foreign matter or ink droplets attached on the discharging opening surface, which is in contact with the surface on which the discharging opening of the recording head 1 is formed.

The recording head 1 mounted on the ink jet recording device as described above includes a discharging opening forming member 26 having a plurality of fine ink discharging openings 27 formed as shown in FIG. 2 (hereinafter called an orifice plate) and a head main body 29 provided with ink channels 24 communicating with the above discharging openings 27. And, a part of the above ink channels 24 is provided with an ink discharging energy generating member (not shown) utilized for discharging ink through the discharging openings 27. For example, when a heat energy generating element which generates heat energy is used as the energy generating member, ink is discharged through the discharging openings by utilizing the abrupt pressure change created by &he bubbles formed by the heat energy.

In the prior art, for the orifice plate 26 constituting the above recording head 1, a flat plate having discharging openings formed at predetermined positions has been used. The orifice plate 26 and the head main body 29 have been secured and bonded by use of a method such as pressure application for example after coating the entire surface of the bonding surface 26*a* of the orifice plate 26 or the bonding surface 25 on the side of the head main body 29 with a bonding agent and then effecting registration between the two. The bonding surface between the orifice plate 26 and the head main body 29 has been made as a flat plane in order to improve adhesion between the two.

However, in the above recording head 1, since the bonding agent intervening between the orifice plate 26 and the head main body 29 shrinks when hardened, stress is generated between these. Also, because there is a difference in the thermal expansion coefficient among the orifice plate 26, the bonding agent and the head main body 29, for example, stress is generated between these in a recording head of the type which utilizes heat energy as the ink discharging energy.

For example, the thermal expansion coefficients and curing shrinkages of borosilicate glass 7740 mentioned below as the material constituting the head main body 29, nickel mentioned below as the material constituting the orifice plate 26 and the two-liquid type epoxy formulated bonding agent Three Bond 2001 (main agent)/2105F (curing agent) mentioned below as the bonding agent used for effecting bonding of the both are shown below in Table 1.

TABLE 1

| Constituent material | Thermal expansion coefficient ($\times 10^{-7}$/°C.) | Curing shrinkage (%) |
|---|---|---|
| Borosilicate glass | 32.5 | — |
| Nickel | 76 | — |
| Bonding agent | 750 | 2-3 |

As is apparent from Table 1, there is 2 to 3% of curing shrinkage of the bonding agent, and the thermal expansion coefficients&are greatly different within the range of one order.

Therefore, there is sufficiently a concern that the stress as described above may be generated.

When such stress occurs between the respective constituent materials, deformation or destruction of the recording head such as distortion, fracture, crack, peeling, etc. is liable to occur, whereby resistance to environment, long term reliability or durability of the recording will deteriorate. Also, in such a recording head, lowering in uniformity of ink droplets or precision of discharging direction, etc. may arise resulting in disturbance of recorded images.

On the other hand, as the constitution which prevents the bimetal effect caused by the stress at the bonding portion, there is one described in Japanese Patent Application No. 56-162079 (Japanese Laid-Open Patent Application No. 58-63473, Japanese Patent Publication No. 64-12234).

The above arrangement absorbs the bimetal effect occurring between the substrate 71 and the mounting plate 72 with the layer of the above adhesive 73 by forming a groove 74 on the mounting plate 72 on which the substrate 71 mounting the heat-generating element 73 is mounted, as shown in FIG. 3, filling an adhesive 73 having rubbery elasticity during curing into the groove 74 and adhering the mounting plate 72 to the substrate 71.

Whereas, when prevention of generation of stress by filling an adhesive having rubbery elasticity into the groove is applied to the ink jet recording head, there is a specific concern that ink may seep out by application of stress on the above adhesive.

For solving this problem, when an adhesive having the characteristic of excellent ink resistance and which is increased in hardness by curing is filled in the groove, the stress absorbed by the rubbery elasticity of the adhesive becomes unabsorbed, whereby there is no resultant effect of buffering the stress.

Accordingly, one may consider choosing a bonding agent excellent in ink resistance and having rubbery elasticity or choosing materials in order to reduce the curing shrinkage of the bonding because of the difference in thermal expansion coefficient between the respective constituent materials. However, it is very difficult to find materials which satisfy all of the various conditions of workability, bondability, ink resistance, etc.

SUMMARY OF THE INVENTION

An object of the present invention is to provide an ink jet recording head excellent in environment resistance, durability, etc. and high in reliability by providing an unevenly shaped groove or island at the bonding surface between the orifice plate and the head main body, thereby liberating or buffering the stress generated due to curing shrinkage of the bonding agent or difference in thermal expansion coefficient between the respective constituent materials through the recessed portion constituting the space formed between the orifice plate and the head main body by the above uneven portion.

Also, since release of heat is promoted by the space formed by the recessed portion, and for example, in a recording head of the serial type, air is moved by scanning, whereby an ink jet recording head excellent in heat releasability can be provided.

It is also another object of the present invention to provide an ink jet recording device satisfying excellent recording characteristics by mounting the ink jet recording head having excellent characteristics as mentioned above.

Still another object of the present invention is to provide an ink jet recording head that includes:

a plate member provided with a discharging opening for discharging ink; and a head main body having an ink channel communicating with the discharging opening which is bonded to the plate member, and an uneven portion being formed at the bonding surface of the plate member with the head main body.

Still another object of the present invention is to provide an ink jet recording device that includes:

an ink jet recording head, the ink jet recording head comprising a plate member provided with a discharging opening for discharging ink; and a head main body having an ink channel communicating with the discharging opening which is bonded to the plate member, and an uneven portion being formed at the bonding surface of the plate member with the head main body; and a cleaning member for cleaning the discharging opening of the plate member and its surrounding portion.

DETAILED DESCRIPTION OF THE PREFERRED EMBODIMENTS

In the following, embodiments of the ink jet recording head of the present invention and the ink jet recording device provided with the recording head are described by referring to the accompanying drawings.

Embodiment 1

Figure 4:
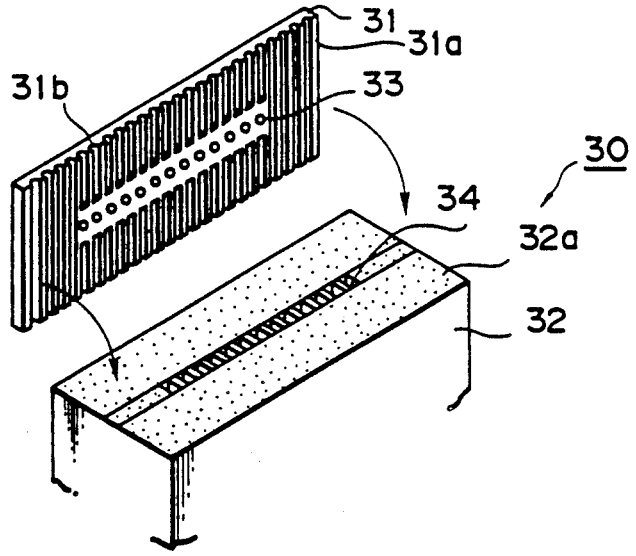
FIGS. 4 through 6 are schematic perspective views showing one embodiment of the ink jet recording head according to the present invention.
Figure 5:
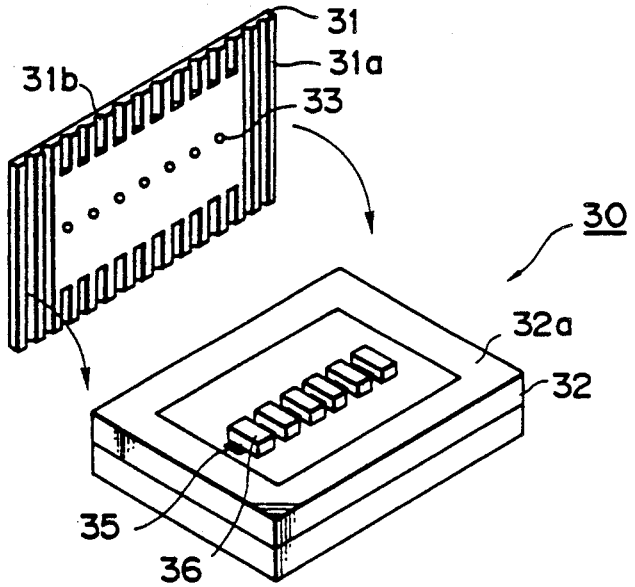
Figure 6:
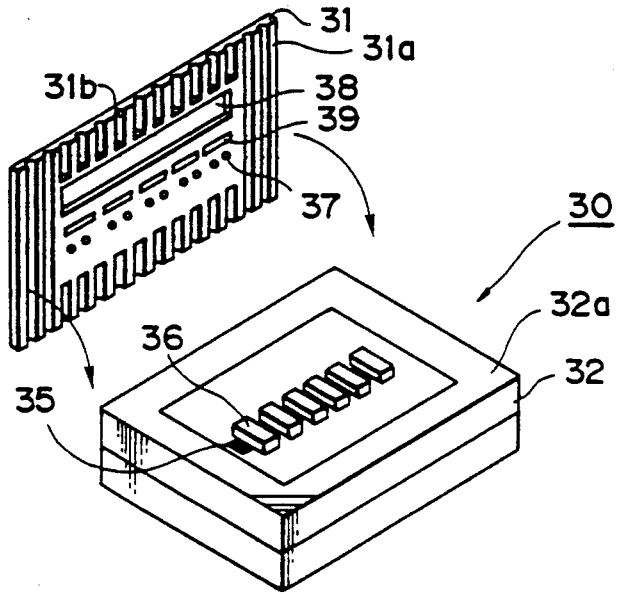

FIGS. 4 through 6 show an embodiment of the ink jet recording head according to the present invention.

Figure 12:
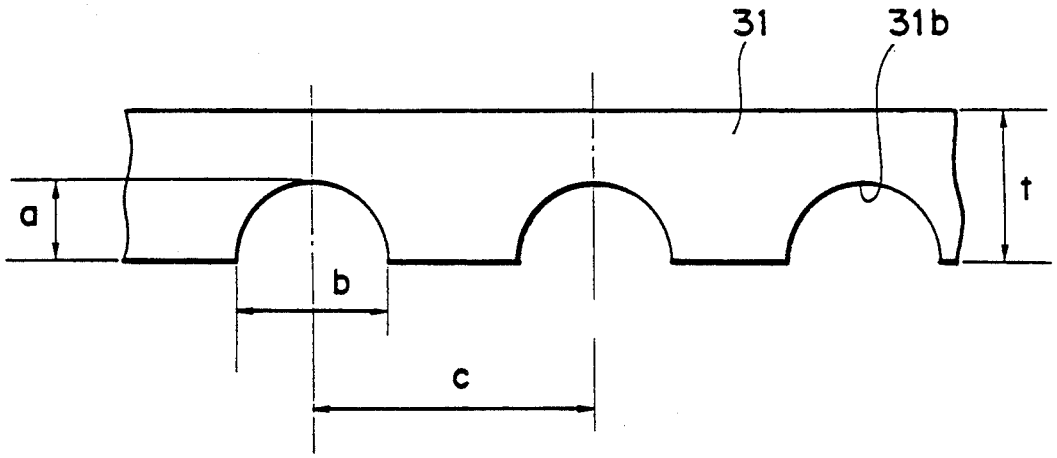
FIG. 12 is a schematic side view showing the recessed portion of the orifice plate.
Figure 4:
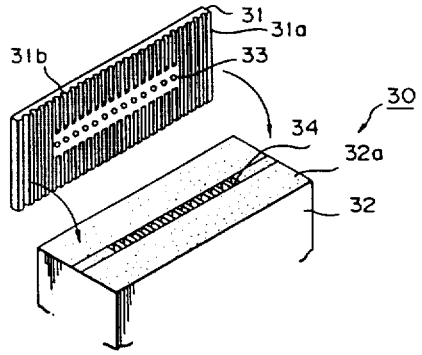
Figure 5:
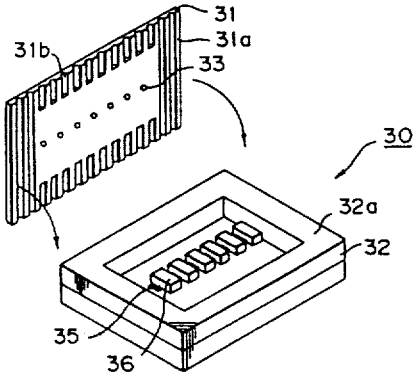
Figure 6:
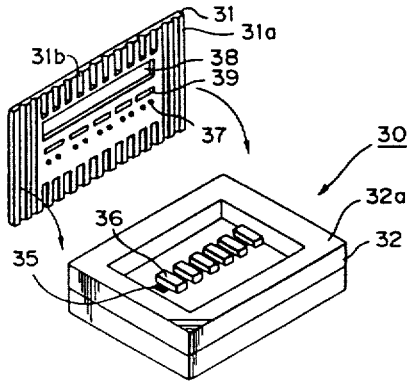

FIG. 4 shows an embodiment of a serial type recording head of the edge shooter type, which is a schematic exploded perspective view of the ink jet recording head 30 having the orifice plate 31 having an uneven groove portion 31*b* formed at the bonding surface 31*a* on the orifice plate 31 side which is the bonding surface with the head main body 32. The size of the groove 31*b* provided on the orifice plate 31 should preferably satisfy the conditions shown below, when the thickness of the orifice plate is made t, the height (depth) of the groove a, the width of the groove b and the pitch of the groove c as shown in FIG. 12:

| | |
|---|---|
| height (depth) of groove a | $\frac{3}{4}t \geqq a \geqq 1/5\,t$ |
| width of groove b | $2/5\,c \geqq b \geqq 1/5\,c$ |
| pitch of groove c | pitch of discharging opening or less. |

The above orifice plate 31 is provided with a plurality of discharging openings 33 for discharging ink and is adapted to discharge ink so that desired images can be recorded following the image signals sent from the wiring plate for transmitting the recording signals to the recording head.

The groove 31*b* provided on the bonding surface 31*a* side of the orifice plate 31 is formed so that communication between the discharging opening 33 provided on the orifice plate 31 and the ink channel of the head main body 32 may be maintained, in the region excluding the peripheral region of the communication portion between the above discharging opening 33 and the above ink channel 34.

The recording head 30 utilizes heat energy during discharging of ink, and is provided with a heat energy generating element for generating the above heat energy within the Ink channel 34 which communicates with the discharging opening of &he above orifice plate.

And, for discharging of ink, the principle described in U.S. Pat. No. 4,723,129 or 4,740,796 is utilized.

Also, the present invention is applicable to &he recording head of the side shooter type as shown in FIG. 4 and FIG. 6.

The head main body 32 of the recording head is provided with an ink channel wall 36 for defining the ink channel, and each ink channel is provided with a heat energy generating element 35 as described above.

The recording head shown in FIG. 4 is constituted of the orifice plate 31 having discharging openings 33 formed corresponding to the respective heat energy generating element 35 bonded to the head main body 32.

The recording head shown in FIG. 6 is provided with a slit 39 in place of the discharging openings 33 provided on the orifice plate 31 of the recording head 30 shown in FIG. 4, and is constituted of a plurality of heat energy generating elements 35 corresponding to one slit 39. The recording head 30 shown in FIG. 6, in addition to the above slit 39 formed on the orifice plate, is provided with an auxiliary hole 37 and the ink reservoir 38 for improving discharging characteristics of the ink.

The case of bonding the orifice plate 31 having the bonding surface 31*a* in the shape as described above to the head main body 32 will now be described.

For bonding the orifice plate 31 to the head main body 32, first an adhesive (e.g. Three Bond 2001/2105) is thinly and uniformly coated on a silicone rubber plate (e.g. Toray SH841U), and the bonding surface 32*a* of the head main body 32 is pushed against its face to have the bonding agent transferred to the entire surface of the bonding surface 32*a* excluding &he ink channel 34.

Next, as shown 1*n* FIGS. 4 through 6, registration is effected so that the bonding surface 31*a* having the groove portion 31*b* formed on the orifice plate 31 may coincide with the bonding surface 32*a* of the head main body 32, followed by pressurization and heating to effect bonding fixing.

Figure 7:
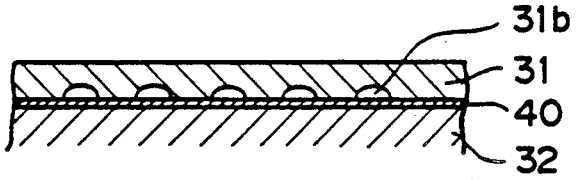
FIG. 7 is a schematic sectional view showing the bonded state of the orifice plate with the head main body.

FIG. 7 is a sectional view showing a part of the bonding portion of the orifice plate 31 and the head main body 32. As is apparent from FIG. 7 in this embodiment, the orifice plate 31 is bonded with the bonding agent layer 40 to the head main body 32, but the grooved in recessed shape 31*b* is not bonded to the head main body 32.

Thus, by forming the groove portion 31*b* which is not bonded to the head main body 32 on a part of the bonding surface 31*a* of the orifice plate 31, the groove portion 31*b* is slightly subjected to elastic deformation, and by such deformation, the stress generated during curing shrinkage of the bonding agent or the stress caused by the difference in thermal expansion coefficient between the respective constituent materials is liberated. Also, by thus providing the groove 31*b*, flowing of the bonding agent between the orifice plate 31 and the head main body 32 near the discharging opening or internally thereof can be prevented. Accordingly, the discharging characteristics will not be lowered. Further, dissipation of the heat of the recording head can be promoted by the space formed by the groove, and Particularly in the recording head of the serial type, air can move by scanning and therefore, a recording head with heat dissipating characteristics can be obtained. Accordingly, destruction of the recording head caused by various stresses generated by changes in the surrounding environment or during prolonged usage can be prevented, and an ink jet recording head excellent in environment resistance, durability, and long term reliability can be provided.

The groove provided on the orifice plate 31 or the head main body 32 can be provided in the direction crossing the arrangement direction of the discharging openings as described above or alternatively, in the direction parallel to the arrangement direction of discharging openings, but it is preferable to provide the groove in the direction crossing with the arrangement direction of the discharging openings from the standpoint of discharging characteristics. Above all, it is particularly preferable to provide the groove in the direction crossing at substantially a right angle with the arrangement direction of the discharging openings.

This because, in the case of the serial type recording head, the groove becomes substantially parallel to the scanning direction, thereby air can flow with ease to enhance the temperature controlling effect of the recording head.

Embodiment 2

Figure 8:
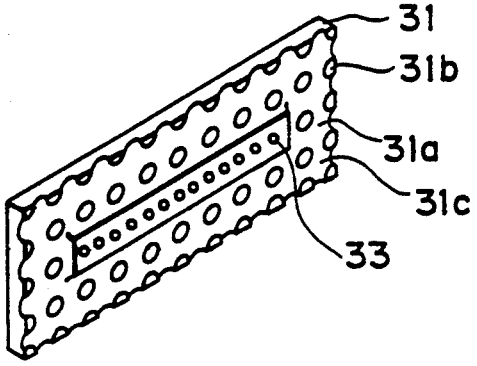
FIG. 8 is a schematic perspective view showing another embodiment of the uneven portion of the orifice plate constituting the ink jet recording head according to the present invention.
Figure 9A:
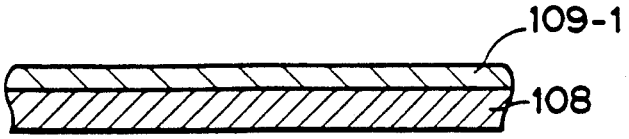
FIGS. 9(*a*) through 9(*g*) are schematic sectional views showing examples of the preparation method of the orifice plate constituting the ink jet recording head according &o the present invention.
Figure 9B:
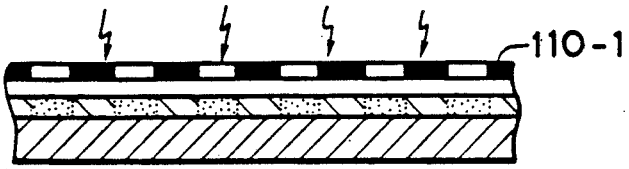
Figure 9C:
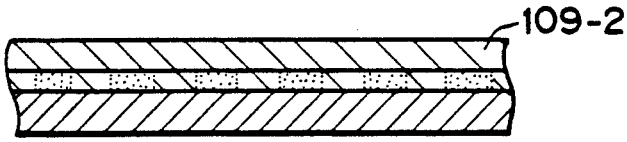
Figure 9D:
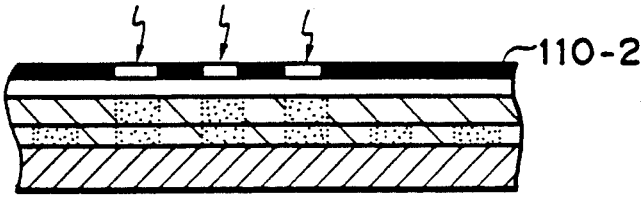
Figure 9E:
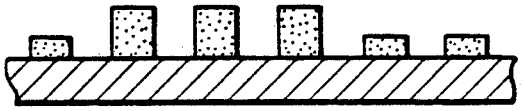
Figure 9F:
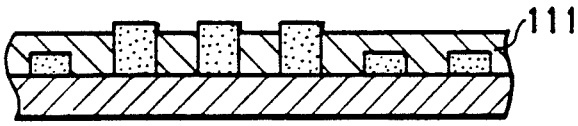
Figure 9G:
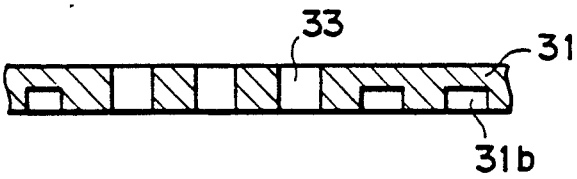

FIG. 8 shows another form of an uneven shape formed on the bonding surface 31*a* side of the orifice plate 31 constituting the ink jet recording head according to the present invention.

Figure 2:
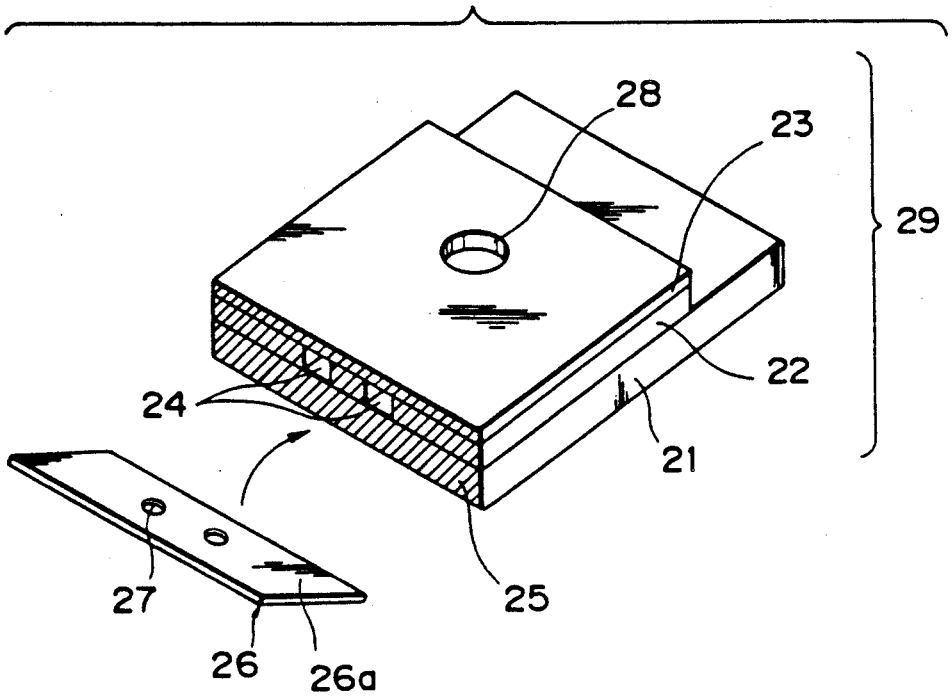
FIG. 2 PRIOR ART
FIG. 2 is a schematic exploded perspective view of the head main body and the orifice plate of the ink jet recording head of the prior art.
Figure 3:
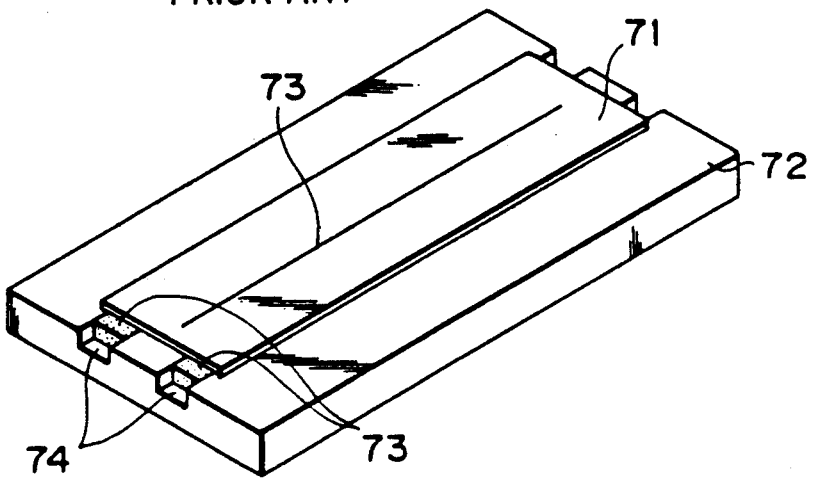
FIG. 3 PRIOR ART
FIG. 3 is a schematic perspective view of a thermal head.

The form of uneven shape shown in FIG. 8 is an island shape. By forming the recessed portion 31*c* so that an island-shaped protruded portion 31*b* may be formed on the bonding surface 31*a* of the orifice plate 31, the same effect as the orifice plate 31 shown in the first embodiment can be obtained. Thus, even when the uneven portion is provided in the shape of an island, it is preferable to form the recessed portion so as to satisfy the conditions shown by referring to FIG. 2. Also, when an island-shaped uneven portion is provided, so that the communication between the discharging opening 33 provided on the orifice plate 31 and the ink channel 34 of the head main body 32 may be maintained, it is required to be formed in the region excluding the peripheral region of the communicating portion of the above discharging opening 33 and the above ink channel 34.

The way in which the bonding agent layer 40 is provided in bonding the orifice plate 31 with the head main body 32 is also the same as shown in the first embodiment and the same effect as in the first embodiment can be obtained.

Having described above embodiments in which a groove-shaped or an island-shaped uneven portion is provided on the bonding surface between the orifice plate and the head main body, the shape is not limited to these, provided that it can satisfy the spirit of the present invention.

Next, the method of forming an uneven portion on the bonding surface 31*a* side of the orifice plate 31 will be described with respect to an example of forming nickel metal by electroforming by referring to FIG. 9 (*a*) through FIG. 9 (*g*).

First, as shown in FIG. 9 (a), on a substrate 108 for electroforming (stainless steel) was laminated a dry film 109-1 comprising a photosensitive resin (Dry Film Sx manufactured by Tokyo Oka).

With a photomask 110-1 covered on the laminate, exposure was effected to perform patterning of the recessed portion and the orifice portion (the same Figure (*b*)).

Further, a dry film 109-2 was laminaed thereon (the same Figure (*c*)), and exposure was effected with a photomask 110-2 covered thereon, to perform patterning of the orifice portion (the same Figure (*d*)).

Next, as shown in the same Figure (e), the dry films 109-1, 109-2 were developed at the same time, and the dry films were cured with UV-ray and heat.

As shown in the same Figure (f), nickel was formed on the substrate by electroforming, and only the nickel layer 111 was taken out to obtain the orifice plate 31 having the unevenness and discharging openings 33 as shown in the same Figure (g).

Figure 1:
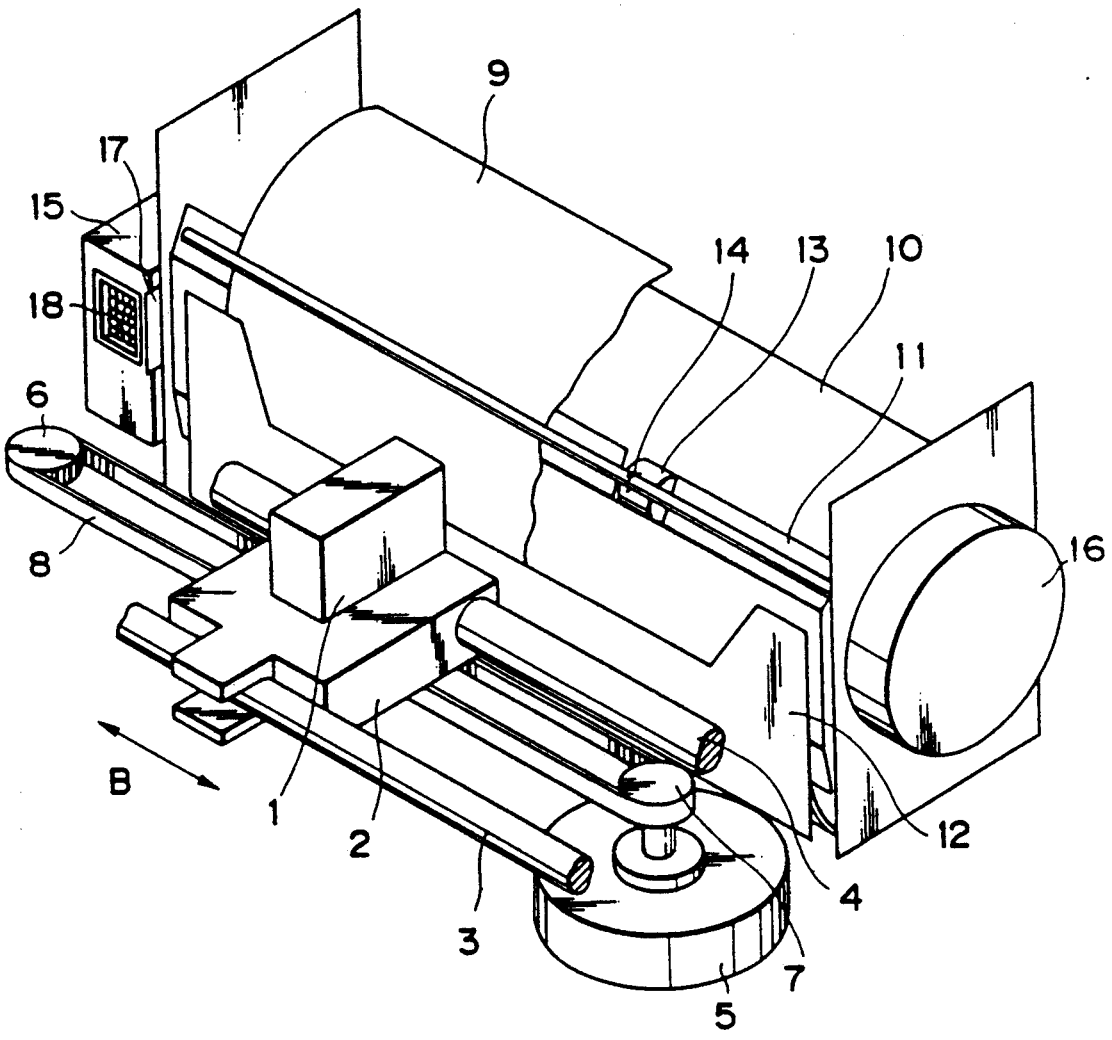
FIG. 1 PRIOR ART
FIG. 1 is a schematic perspective view of an an ink jet recording device.

As described above, the recording head as shown in the first embodiment or the second embodiment can be mounted on, for example, an ink jet recording device as shown in FIG. 1.

Even when mounted on such a recording device, since the recording head is excellent in environment resistance, long term reliability or durability, excellent recorded images can be obtained without bringing about a lowering in uniformity of ink droplets or precision of discharging direction.

The recording head shown in the above first embodiment or the second embodiment is also applicable to a recording head of the type exchangeable for the ink jet recording device.

Embodiment 3

Figures 10, 11:
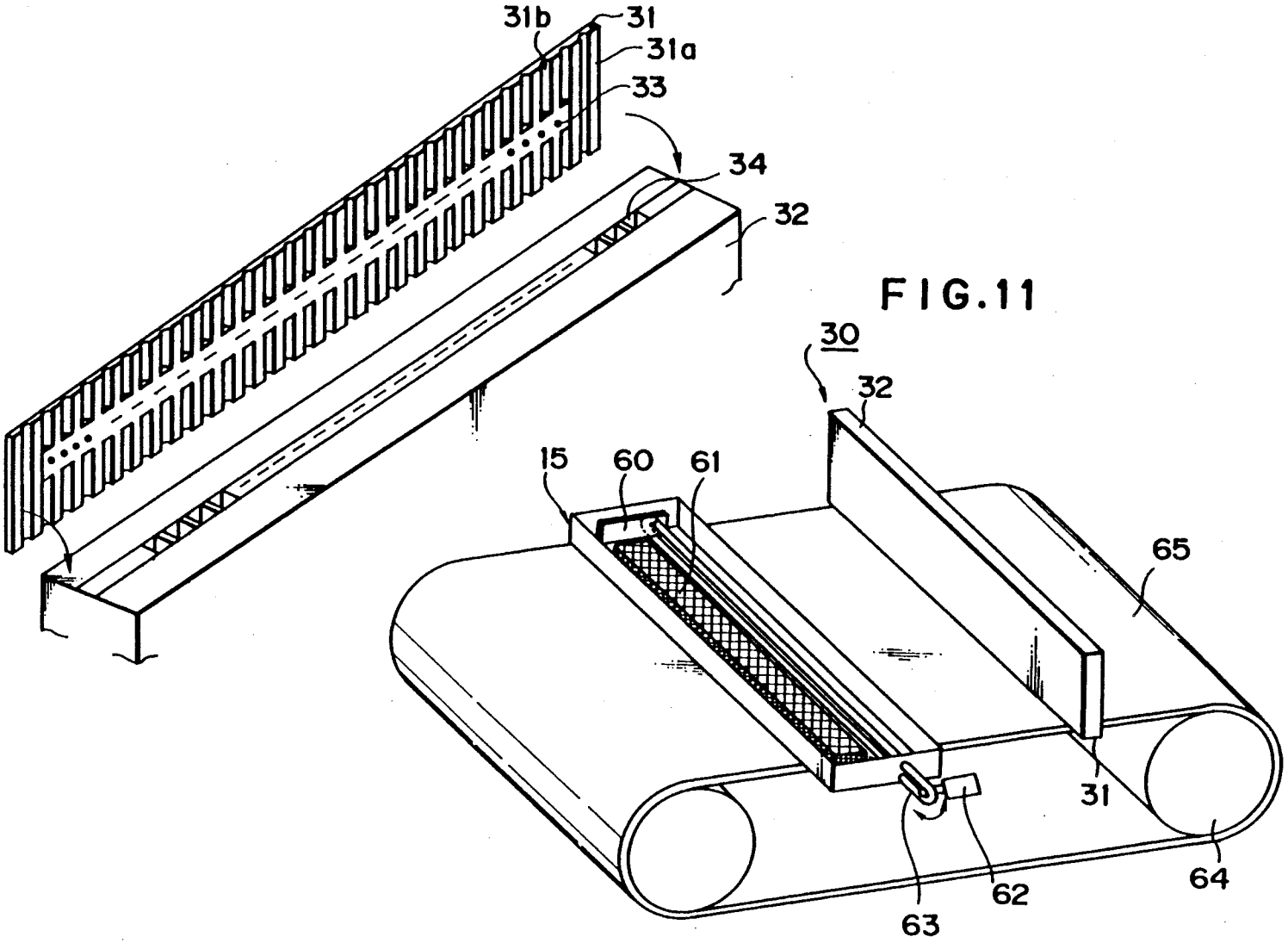
FIG. 10 is a schematic perspective view showing another embodiment of the ink jet recording head according to the present invention.
FIG. 11 is a schematic perspective view showing an embodiment of the ink jet recording device provided with the ink jet recording head shown in FIG. 10.

Further, the present invention is not limited to the recording head and the recording device of the serial type as described above, but is also applicable to the recording head and the recording device of the full line type as shown in FIG. 10 and FIG. 11.

FIG. 10 is an example when applied to the recording head of the full line type. The basic constitution is the same as the recording head as described in the first embodiment or the second embodiment.

Also, in the recording head of the full line type, by forming a space with a recessed portion, the temperature controlling effect can be obtained. In the case of the full line type recording head, by deforming the recessed portion with the central part and both ends of the head, for example, by making a large recessed portion at the central portion and a small recessed portion at both ends temperature control specific in head length can be effected.

FIG. 11 schematically illustrates the recording device on which the recording head is mounted. In FIG. 11, 65 is a conveying belt for conveying the recording medium, and the conveying belt 65 conveys the recording medium as accompanied with the rotation of the conveying roller 64. Reference numeral 61 represents a restoration unit, and its function is the same as in the recording device having the recording head of the serial type mounted thereon as described above. In the restoration unit, 60 is a cleaning blade, and when the recording head 30 is housed within the restoration unit 15, cleaning is performed by driving and scanning the discharging opening surface of the recording head together with the belt 63 driven by rotation of the motor 62. 61 is reference numeral 61 represents an absorbing member which may also be used in place of the cleaning blade 60 for performing cleaning in contact with the discharging surface 51*a* of the recording head.

As is apparent from the above description, the ink jet recording head according to the present invention has an uneven portion formed on either one bonding surface of the orifice plate and the head main body, and therefore, can provide an ink jet recording head excellent in environment resistance, durability, etc. and high in reliability by liberating the stresses generated by the curing shrinkage and the difference in thermal expansion coefficient between the respective constituent materials.

In addition, the range of choosing materials can be expanded, whereby the degree of freedom in designing can be expanded.

Also, by mounting the ink jet recording head having excellent characteristics a described above, an ink jet recording device satisfying excellent recording characteristics can be provided.

What we claim is:

1. An ink jet recording head comprising:

a plate member provided with a discharging opening for discharging ink;

a head main body having an ink channel communicating with the discharging opening, said head main body being bonded to said plate member at a bonding surface; and an uneven portion comprising a protruding portion and a recessed portion being formed at the bonding surface of said plate member and said head main body;

wherein the recessed portion of said uneven portion at the bonding surface comprises a groove and is formed in a region excluding the peripheral region of the communicating portion between the ink channel of said head main body and the discharging opening of said plate member and wherein said plate member and said head main body in the protruding portion are bonded by an adhesive to form a gap between said head main body and said plate member at the forming region of said groove.

2. An ink jet recording head according to claim 1, wherein said ink jet recording head further comprises a heat energy generating element for generating heat energy to discharge ink from said recording head, and ink is discharged through the discharging opening of said plate member by abruptly changing pressure created by a bubble formed by the heat energy generated by said heat energy generating element.

3. An ink jet recording head according to claim 2, wherein a plurality of discharging openings are provided and a plurality of said heat energy generating elements are provided corresponding to each one of the plurality of discharging openings.

4. An ink jet recording head according to claim 2, wherein a plurality of said heat energy generating elements are provided corresponding to one of the discharging openings.

5. An ink jet recording head according to claim 1, wherein the groove of the uneven portion formed on said plate member is aligned in a direction crossing the arrangement direction of the discharging openings.

6. An ink jet recording head according to claim 1, wherein the groove of the uneven portion formed on said plate member is aligned in a direction parallel to the arrangement direction of the discharging openings.

7. An ink jet recording head comprising:

a plate member provided with a discharging opening for discharging ink;

a head main body having an ink channel communicating with the discharging opening, said head main body being bonded to said plate member at a bonding surface; and an uneven portion comprising a protruding portion and a recessed portion being formed at the bonding surface of said plate member and said head main body;

wherein said uneven portion is island-shaped and the recessed portion of said uneven portion at the bonding surface is formed in a region excluding the peripheral region of the communicating portion between the ink channel of said head main body and the discharging opening of said plate member and wherein said plate member and said head main body are bonded by an adhesive at the protruding portion of the uneven portion to form a gap between said plate member and said head main body at the recessed portion of the uneven portion.

8. An ink jet recording head according to claim 7, wherein said ink jet recording head further comprises a heat energy generating element for generating heat energy to discharge ink from said recording head, and ink is discharged through the discharging opening of said plate member by abruptly changing pressure created by a bubble formed by the heat energy generated by said heat energy generating element.

9. An ink jet recording head according to claim 8, wherein a plurality of discharging openings are provided and a plurality of said heat energy generating elements are provided corresponding to each one of the plurality of discharging openings.

10. An ink jet recording head according to claim 8, wherein a plurality of said heat energy generating elements are provided corresponding to one of the discharging openings.

11. An ink jet recording head comprising:

a plate member provided with a discharging opening for discharging ink;

a head main body having an ink channel communicating with the discharging opening, said head main body being bonded to said plate member at a bonding surface; and an uneven portion comprising a protruding portion and a recessed portion being formed at the bonding surface of said plate member and said head main body;

wherein said uneven portion is island-shaped and the recessed portion of said uneven portion comprises a groove and said plate member and said head main body in the protruding portion are bonded by an adhesive to form a gap between said head main body and said plate member at the forming region of said groove and wherein said plate member and said head main body are bonded by an adhesive at the protruding portion of the uneven portion to form a gap between said plate member and said head main body at the recessed portion of the uneven portion.

12. An ink jet recording head according to claim 11, wherein the groove of the uneven portion formed on said plate member is aligned in a direction crossing the arrangement direction of the discharging openings.

13. An ink jet recording head according to claim 11, wherein the groove of the uneven portion formed on said plate member is aligned in a direction parallel to the arrangement direction of the discharging openings.

14. An ink jet recording head comprising:

a plate member provided with a discharging opening for discharging ink; and a head main body having an ink channel communicating with the discharging opening, said head main body being bonded to said plate member at a bonding surface; and an uneven portion comprising a recessed portion being formed at the bonding surface of said plate member and said head main body, wherein when the thickness of said plate member is t, the depth of the recessed portion a, the width of the recessed portion b and the pitch of the recessed portion c, the following conditions are satisfied:

| | |
|---|---|
| depth of groove a | $\frac{3}{4} t \geqq a \geqq 1/5\ t$ |
| width of groove b | $2/5\ c \geqq b \geqq 1/5\ c$ |
| pitch of groove c | less than or equal to pitch of discharging opening |

15. An ink jet recording head according to claim 14, wherein the groove of the uneven portion formed on said plate member is aligned in a direction crossing the arrangement direction of the discharging openings.

16. An ink jet recording head according to claim 14, wherein the groove of the uneven portion formed on said plate member is aligned in a direction parallel to the arrangement direction of the discharging openings.

17. An ink jet recording device comprising:

an ink jet recording head comprising a plate member provided with a discharging opening for discharging ink, a head main body having an ink channel communicating with the discharging opening, said head main body being bonded to said plate member at a bonding surface and an uneven portion comprising a protruding portion and a recessed portion being formed at the bonding surface of said plate member and said head main body;

wherein the recessed portion of said uneven portion at the bonding surface comprises a groove and is formed in a region excluding the peripheral region of the communicating portion between the ink channel of said head main body and the discharging opening of said plate member and wherein said plate member and said head main body in the protruding portion are bonded by an adhesive to form a gap between said head main body and said plate member at the forming region of said groove; and transfer means for transferring recording paper having recording effected thereon by ink discharged from said recording head.

18. An ink jet recording device according to claim 17, wherein said ink jet recording head comprises a full line type head having a plurality of discharging openings for printing one line width in a direction crossing the conveying direction of the recording medium.

19. An ink jet recording device according to claim 18, further comprising a cleaning member for cleaning while moving in contact with the surface of said plate member of said recording head.

20. An ink jet recording device according to claim 18, further comprising a cleaning member comprising an absorbing material which absorbs foreign matter or ink by contacting the surface of said plate member of said recording head.

21. An ink jet recording device according to claim 17, wherein said ink jet recording head comprises a serial type head for printing by scanning relative to the recording medium.

22. An ink jet recording device according to claim 21, further comprising a cleaning member for cleaning by contacting the surface of said plate member during scanning of said recording head.

23. An ink jet recording device according to claim 21, further comprising an uneven portion formed on said plate member of said recording head being formed parallel to the scanning direction of the recording head.

24. An ink jet recording head comprising:

a plate member provided with a discharging opening for discharging ink; and a head main body having an ink channel communicating with the discharging opening, said head main body being bonded to said plate member at a bonding surface; and an uneven portion comprising a recessed portion being formed at the bonding surface of said plate member and said head main body, the recessed portion of said uneven portion comprising an area for reducing stress caused by temperature difference between said plate member and said head main body.

25. An ink jet recording head according to claim 24, wherein said head main body and said plate member have a different thermal expression coefficient.

* * * * *

UNITED STATES PATENT AND TRADEMARK OFFICE

CERTIFICATE OF CORRECTION

PATENT NO. : 4,994,825 Page 1 of 3

DATED : February 19, 1991

INVENTOR(S) : AKIO SAITO ET AL.

It is certified that error appears in the above-identified patent and that said Letters Patent is hereby corrected as shown below: Title page:

At [56] REFERENCES CITED,

FOREIGN PATENT DOCUMENTS,
"118873 12/1980 Japan ." should read
--118873 9/1980 Japan .--.

IN THE DRAWINGS

Kindly replace Sheet 3 of 7 with the attached corrected Sheet 3 of 7.

COLUMN 1

Line 30, "shafts 3.4" should read --shafts 3,4--; and
Line 46, "&he" should read --the--.

COLUMN 2

Line 7, "&he" should read --the--; and
Line 52, "coefficents&are" should read --coefficients are --.

COLUMN 3

Line 3, "bimetaI" should read --bimetal--.

COLUMN 4

Line 10, "of an an" should read --of an example of an--; and
Line 30, "&o" should read --to--.

UNITED STATES PATENT AND TRADEMARK OFFICE

CERTIFICATE OF CORRECTION

PATENT NO. : 4,994,825 Page 2 of 3

DATED : February 19, 1991

INVENTOR(S) : AKIO SAITO ET AL.

It is certified that error appears in the above-identified patent and that said Letters Patent is hereby corrected as shown below:

COLUMN 5

Line 18, "Ink" should read --ink--;
Line 19, "&he" should read --the--;
Line 23, "&he" should read --the--; and
Line 25, "FIG. 6" should read --FIG. 5--.

COLUMN 6

Line 13, "Particularly" should read --particularly--;
Line 29, "with" should be deleted; and
Line 37, "thereby" should read --whereby--.

COLUMN 8

Line 3, "numeral 61" should read --numeral 15--;
Line 12, "61 is reference numeral 61" should read --Reference numeral 61--;
Line 18, "one" should be deleted; and
Line 29, "a" should read --as--.

Signed and Sealed this

Twelfth Day of January, 1993

*Attest:*

DOUGLAS B. COMER

*Attesting Officer*

*Acting Commissioner of Patents and Trademarks*